US010392231B2

(12) United States Patent
Sansevero

(10) Patent No.: US 10,392,231 B2
(45) Date of Patent: Aug. 27, 2019

(54) ESCALATOR SYSTEM WITH VERTICAL STEP RISERS AND STEP-MOUNTED ANGLED SIDE FLANGES

(71) Applicant: Frank Mario Sansevero, Wakefield, RI (US)

(72) Inventor: Frank Mario Sansevero, Wakefield, RI (US)

( * ) Notice: Subject to any disclaimer, the term of this patent is extended or adjusted under 35 U.S.C. 154(b) by 0 days.

(21) Appl. No.: 16/294,760

(22) Filed: Mar. 6, 2019

(65) Prior Publication Data

US 2019/0202668 A1 Jul. 4, 2019

Related U.S. Application Data

(63) Continuation-in-part of application No. PCT/IB2017/055255, filed on Aug. 31, 2017.

(60) Provisional application No. 62/384,067, filed on Sep. 6, 2016.

(51) Int. Cl.

| | |
|---|---|
| ***B66B 29/02*** | (2006.01) |
| ***B66B 21/04*** | (2006.01) |
| ***B66B 23/02*** | (2006.01) |
| ***B66B 23/14*** | (2006.01) |
| ***B66B 23/12*** | (2006.01) |

(52) U.S. Cl.

CPC ..... *B66B 29/02* (2013.01); *B66B 21/04* (2013.01); *B66B 23/024* (2013.01); *B66B 23/026* (2013.01); *B66B 23/12* (2013.01); *B66B 23/14* (2013.01)

(58) Field of Classification Search

CPC ..... B66B 21/04; B66B 23/024; B66B 23/026; B66B 23/14; B66B 29/02; B66B 23/12

USPC ..... 198/333

See application file for complete search history.

(56) References Cited

U.S. PATENT DOCUMENTS

| | | | |
|---|---|---|---|
| 3,986,595 | A | 10/1976 | Asano et al. |
| 4,411,352 | A | 10/1983 | Kettle |
| 4,949,832 | A | 8/1990 | Sansevero |
| 5,009,302 | A | 4/1991 | Sansevero |
| 5,115,899 | A | 5/1992 | Nakatani |
| 5,184,710 | A | 2/1993 | Nakatani |

(Continued)

FOREIGN PATENT DOCUMENTS

| | | | |
|---|---|---|---|
| KR | 100547315 | B1 | 1/2006 |
| SU | 210344 | A1 | 4/1968 |
| WO | WO2009090282 | A1 | 7/2009 |

*Primary Examiner* — Mark A Deuble

(57) ABSTRACT

An escalator system with vertical step risers and side flanges includes a plurality of escalator steps, at least one varying length drive mechanism, a first decking, and a second decking. Each of the plurality of escalator steps includes an elongated step body, a first step mounted angled flange, and a second step mounted angled flange. The elongated step body transports passengers along the escalator path. The first step mounted angled flange and the second step mounted angled flange connect to form continuous barriers that prevent entrapment of objects between the moving steps and stationary panels. The at least one varying length drive mechanism prevents horizontal movement between each of the plurality of escalator steps traveling along the passenger side, thereby preventing entrapment of objects between adjacent steps. The first decking and the second decking partially cover the first step mounted angled flange and the second step mounted angled flange.

16 Claims, 11 Drawing Sheets

(56) References Cited

U.S. PATENT DOCUMENTS

| | | | | |
|---|---|---|---|---|
| 5,560,468 | A * | 10/1996 | Inoue | B66B 23/12 198/333 |
| 6,213,278 | B1 | 4/2001 | Tanigawa | |
| 6,450,316 | B1 * | 9/2002 | Stuffel | B66B 23/02 198/326 |
| 6,899,216 | B2 | 5/2005 | Levy | |
| 7,568,570 | B2 * | 8/2009 | Stripling | B66B 29/005 198/322 |
| 8,511,455 | B2 * | 8/2013 | Gonzalez Alemany | B66B 23/12 198/333 |
| 9,850,099 | B2 * | 12/2017 | Hoopes | B66B 29/02 |
| 2006/0102447 | A1 * | 5/2006 | Illedits | B66B 23/12 198/326 |
| 2011/0233029 | A1 * | 9/2011 | Fargo | B66B 23/12 198/327 |
| 2018/0155157 | A1 * | 6/2018 | Michalke | B66B 23/026 |

* cited by examiner

ESCALATOR SYSTEM WITH VERTICAL STEP RISERS AND STEP-MOUNTED ANGLED SIDE FLANGES

The current application is a continuation-in-part (CIP) application of the Patent Cooperation Treaty (PCT) application PCT/IB2017/055255 filed on Aug. 31, 2017. The PCT application PCT/IB2017/055255 claims a priority to the U.S. Provisional Patent application Ser. No. 62/384,067 filed on Sep. 6, 2016.

FIELD OF THE INVENTION

The present invention relates to inclined passenger conveyor systems. More specifically, the present invention relates to an escalator system with vertical step risers and step mounted angled side flanges that reduces the likelihood of entrapment of objects between the moving steps and the stationary panels and between adjacent steps.

BACKGROUND OF THE INVENTION

Conventional escalators have steps without protective flanges. There is inherent relative motion between the moving steps and the stationary panels. This relative motion between the moving steps and the stationary panels occurs throughout the passenger side length of the escalator and is most significant in the transitions zone where there is also horizontal movement between the curved step riser and the cleated trailing edge of the adjacent step.

As the steps go through the transition zones with a straight step chain, the steps move closer and overlap each other. This overlapping does not allow for the addition of a "fixed single member" step side flange because it would interfere with the adjacent flange.

An issue with conventional escalators is the possibility of entrapments of objects between the moving steps and the stationary panels and between adjacent steps. This possibility is greatest in the transition zone.

Various solutions have been proposed or developed at reducing the likelihood of entrapments occurring including moveable side panels and flanges. For example, there are solutions that have a flange fixed to the step and a second panel member attached to a link that is part of the step drive system. This dual panel flange system was implemented in the market place but was withdrawn in a relative short period of time after introduction.

In another example, there are solutions that address the horizontal movement between the curved step riser and the cleated trailing edge of the adjacent step with the introduction of the vertical planar step riser. However, this solution was not introduced into the marketplace.

There remains a need to protect against both potential entrapment issues between the moving step and stationary panels and between adjacent steps with a design solution that is robust for manufacturing and during operation making the invention more practical than previous solutions.

DETAILED DESCRIPTION OF THE INVENTION

All illustrations of the drawings are for the purpose of describing selected versions of the present invention and are not intended to limit the scope of the present invention.

Figure 1A:
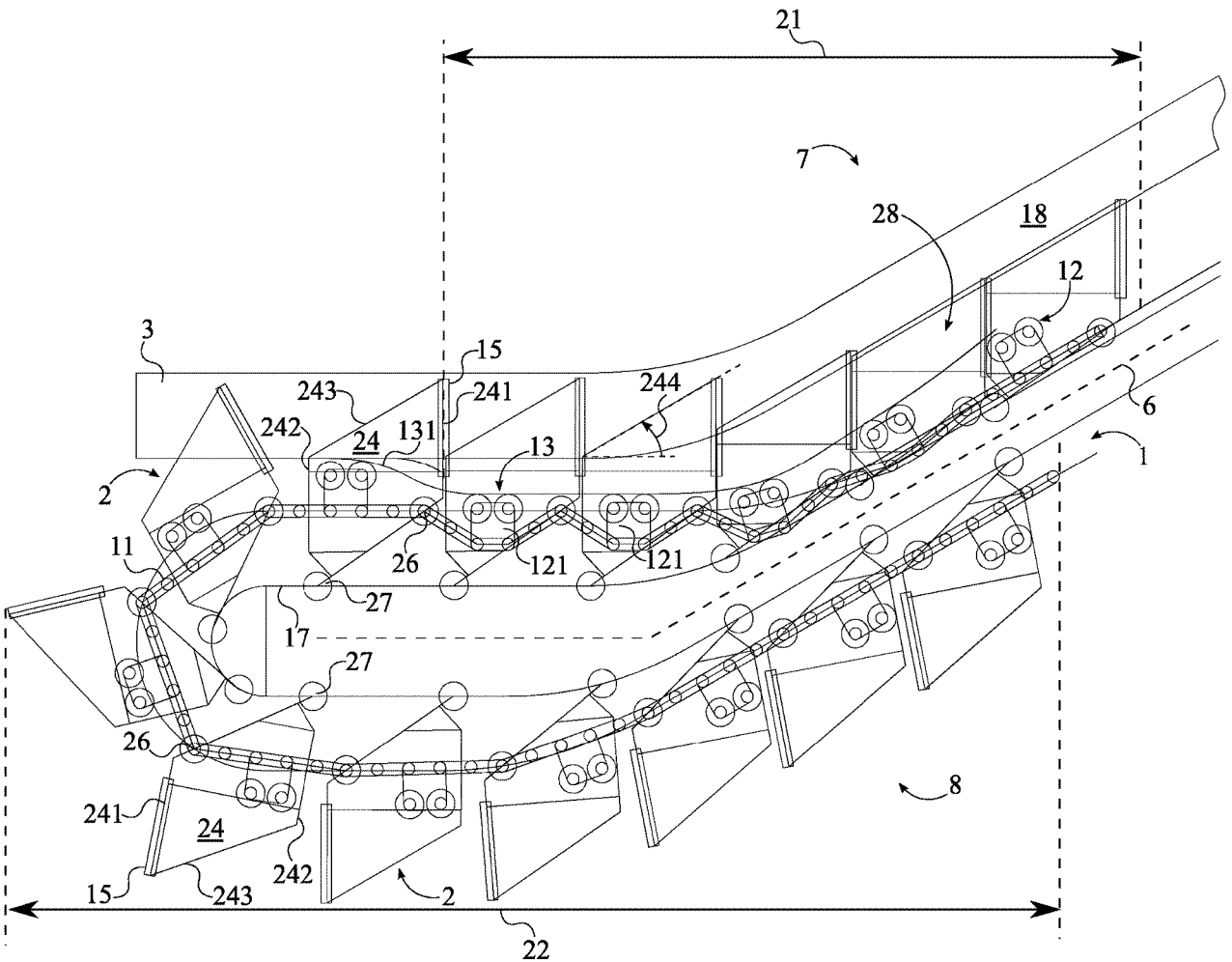
FIG. 1A is a side planform view of the first turnaround section of the escalator path as the plurality of escalator steps travels from the return side to the passenger side of the escalator path.

The present invention is an escalator system with vertical step risers and side flanges that reduces the likelihood of entrapment of objects between the moving steps and the stationary panels and between adjacent steps. The preferred embodiment of the present invention comprises a plurality of escalator steps 2, at least one varying length drive mechanism 1, a first decking 3, and a second decking 4. FIG. 1A shows the plurality of escalator steps 2 serially linked to each other. The plurality of escalator steps 2 transports passengers along a passenger side 7 of the escalator path 6. A return side 8 is positioned opposite the passenger side 7 and returns the plurality of escalator steps 2 to the start of the passenger side 7.

Figure 3:
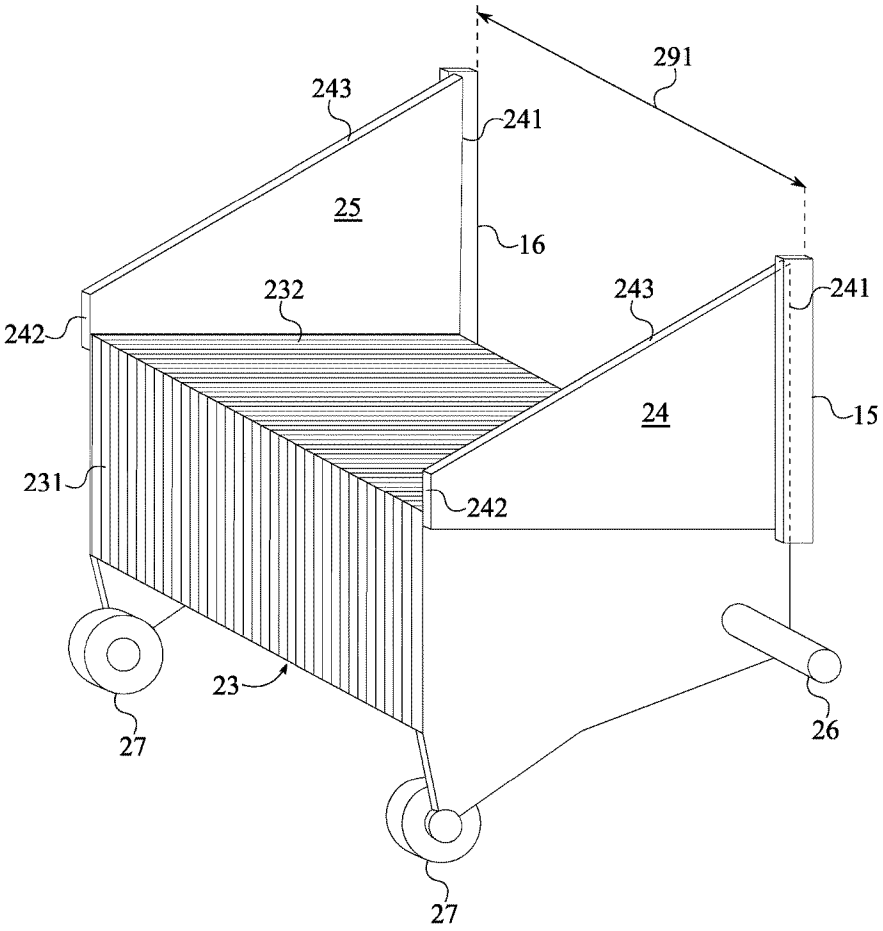
FIG. 3 is a perspective view of the preferred embodiment of one of the plurality of escalator steps.

In reference to FIG. 3, each of the plurality of escalator steps 2 comprises an elongated step body 23, a first step mounted angled flange 24, a first flange interface 15, a second step mounted angled flange 25, and a second flange interface 16. The elongated step body 23 comprises a riser surface 231 and a stepping surface 232. The at least one varying length drive mechanism 1 is configured to move the plurality of escalator steps 2 in a loop around an escalator path 6 while changing a distance between step attachment points while traveling through a passenger side 7 of the escalator path 6 in a manner that does not impart any horizontal acceleration while the plurality of escalator steps 2 move vertically through transition zones while maintaining intermeshing of the plurality of escalator steps 2. The riser surface 231 and the stepping surface 232 are positioned perpendicular or nearly perpendicular with each other. As the plurality of escalator steps 2 travels along the passenger side 7, the riser surface 231 of an arbitrary step from the plurality of escalator steps 2 rises over the stepping surface 232 of an adjacent step from the plurality of escalator steps 2. The perpendicular to nearly perpendicular positioning between the stepping surface 232 and the riser surface 231 prevents the likelihood of entrapments of objects between the any two of the plurality of escalator steps 2 when the riser surface 231 rises over the stepping surface 232.

Figure 1B:
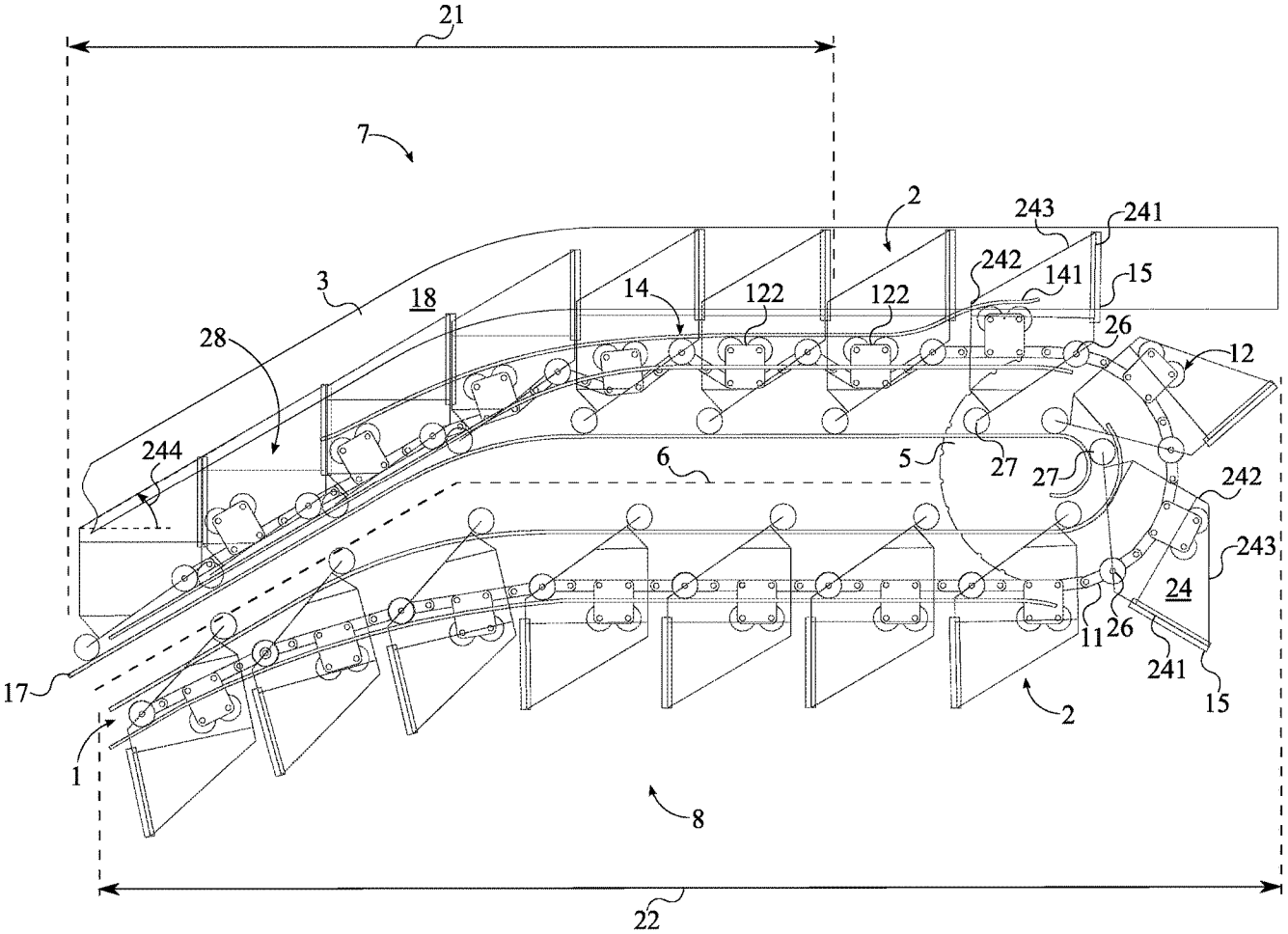
FIG. 1B is a side planform view of the second turnaround section of the escalator path as the plurality of escalator steps travels from the passenger side to the return side of the escalator path.
Figure 2:
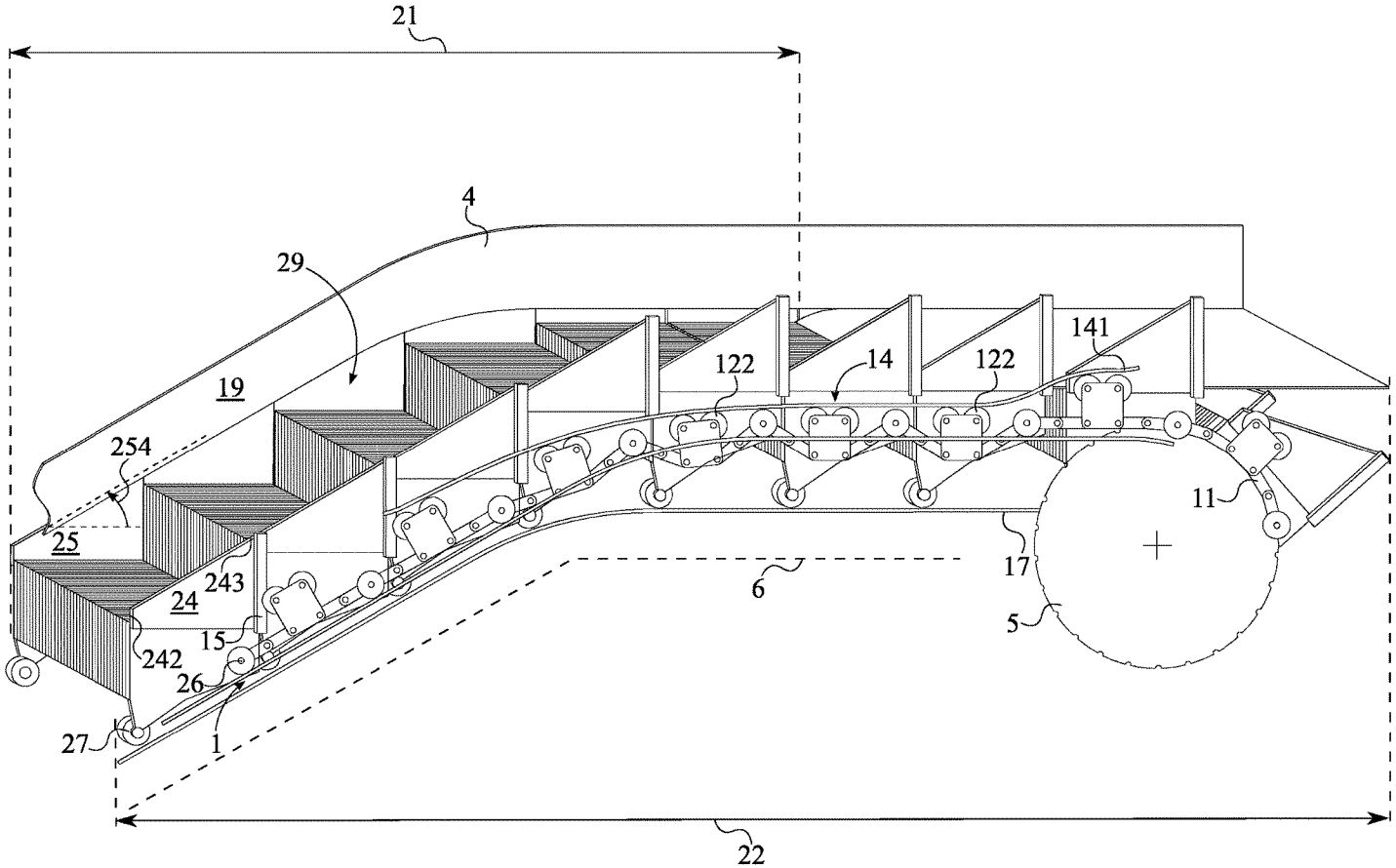
FIG. 2 is a perspective view of the second turnaround section with the second decking and the second step mounted angled flange of the plurality of escalator steps configured to form the second continuous barrier.

As can be seen FIG. 1B and FIG. 2, in the preferred embodiment, the at least one varying length drive mechanism 1 is a pair of varying length drive mechanisms positioned opposite each other about the elongated step body 23. Thus, the varying length drive mechanism 1 enables motorized propulsion of the plurality of escalator steps 2 around the escalator path 6. The first step mounted angled flange 24 is terminally connected to the elongated step body 23. Likewise, the second step mounted angled flange 25 is terminally connected to the elongated step body 23. More specifically, the first step mounted angled flange 24 is located opposite to the second step mounted angled flange 25, along the elongated step body 23. As such, the first step mounted angled flange 24 and the second step mounted angled flange 25 form barriers on opposite ends of the elongated step body 23. In addition, the first step mounted angled flange 24 and the second step mounted angled flange 25 each extend away from the stepping surface 232 so that a first formed angle 244 is parallel or nearly parallel to the first decking interface 18 and a second formed angle 254 is parallel or nearly parallel to the second decking interface 19 thereby minimizing decking heights. This allows the first step mounted angled flange 24 and the second step mounted angled flange 25 to span the vertical distance between the elongated step body 23 and the first decking 3 and the second decking 4.

Referring once more to FIGS. 1A, 1B, and 2, in the preferred implementation of the present invention, the first step mounted angled flange 24 for each of the plurality of escalator steps 2 is configured to form a first continuous barrier 28 between the first decking 3 and the elongated step body 23 for each of the plurality of escalator steps 2. More specifically, the first step mounted angled flange 24 of the arbitrary escalator step is positioned coincident and adjacent to the first step mounted angled flange 24 of a consecutive one of the plurality of escalator steps 2. Likewise, the second step mounted angled flange 25 for each of the plurality of escalator steps 2 is configured to form a second continuous barrier 29 between the second decking 4 and the elongated step body 23 for each of the plurality of escalator steps 2. More specifically, the second step mounted angled flange 25 of one of the plurality of escalator steps 2 is positioned coincident and adjacent to the second step mounted angled flange 25 of a consecutive one of the plurality of escalator steps 2. Both the first continuous barrier 28 and the second continuous barrier 29 are positioned adjacent to the passenger side 7 of the escalator path 6. This prevents the first continuous barrier 28 and the second continuous barrier 29 from separating from the first decking 3 and second decking 4 while traveling along the passenger side 7.

Figure 4:
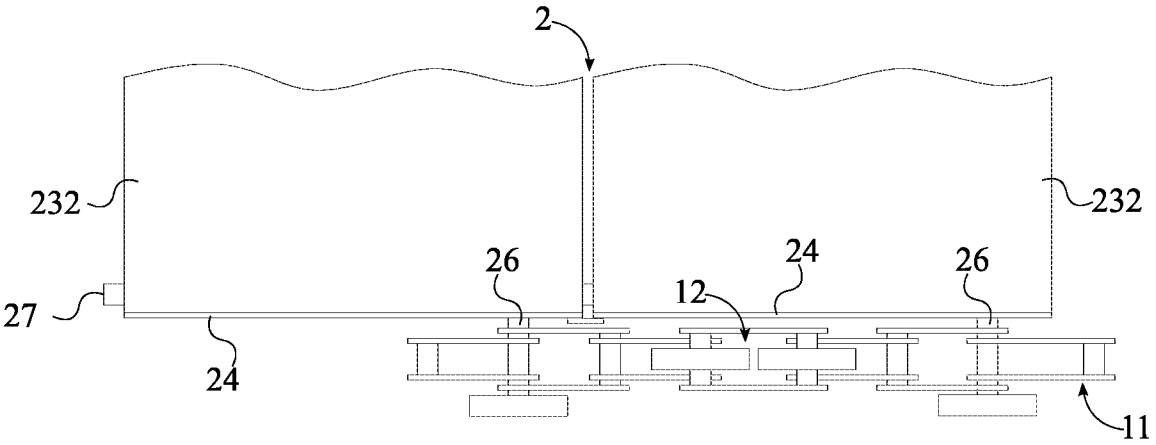
FIG. 4 is a top planform view of the preferred embodiment of the plurality of escalator steps, their step axles, and step chain.
Figure 5:
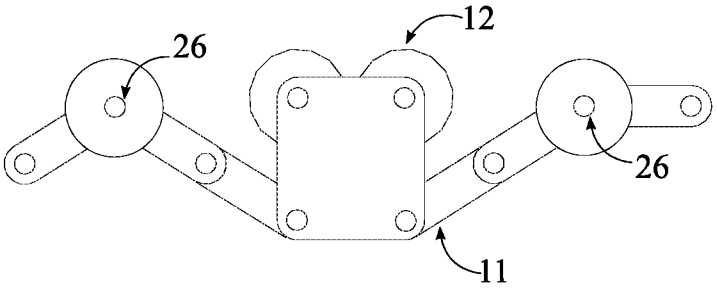
FIG. 5 is a side planform view of one of the plurality of outward facing deflector rollers engaged to the looping step chain.

Referring FIG. 2-4, the first step mounted angled flange 24 also provides the first continuous barrier 28 along the side of the elongated step body 23. As such, the first step mounted angled flange 24 and the second step mounted angled flange 25 each comprise a leading edge 241, a distal edge 243 and a trailing edge 242. The leading edge 241 and the trailing edge 242 each are positioned adjacent to the distal edge 243. The leading edge 241 and the trailing edge 242 are located opposite to each other. The leading edge 241 is positioned opposite to the riser surface 231 across the stepping surface 232. This positions the first step mounted angled flange 24 of an arbitrary step from the plurality of escalator steps 2 coincident to the first step mounted angled flange 24 of an adjacent step from the plurality of escalator steps 2. Similarly, the second step mounted angled flange 25 of an arbitrary step from the plurality of escalator steps 2 is positioned coincident to the second step mounted angled flange 25 of an adjacent step from the plurality of escalator steps 2. Thus, the first flange interface 15 and the second flange interface 16 of an arbitrary step is positioned to overlap the first step mounted angled flange 24 and the second step mounted angled flange 25 of a subsequent step. Further, this also positions the leading edge 241 and the trailing edge 242 parallel to each other.

Further, the first flange interface 15 is connected along the leading edge 241 of the first step mounted angled flange 24. This positions the first step mounted angled flange 24 of an arbitrary step from the plurality of escalator steps 2 coincident to the first step mounted angled flange 24 of an adjacent step from the plurality of escalator steps 2. Similarly, the second flange interface 16 is connected along the leading edge 241 of the second step mounted angled flange 25. As such, the second step mounted angled flange 25 of an arbitrary step overlaps a portion of an adjacent step. More specifically, the first flange interface 15 of an arbitrary step overlaps the trailing edge 242 of the first step mounted angled flange 24 of a subsequent step. Further, the first flange interface 15 of an arbitrary step overlaps the outer lateral face of the first flange belonging to the subsequent step. Similarly, the second flange interface 16 of the arbitrary step overlaps the trailing edge 242 of the second step mounted angled flange 25 of the subsequent step. Thus, the first flange interface 15 and the second flange interface 16 of an arbitrary step is positioned to overlap the first flange interface 15 and the second flange interface 16 respectively, of a subsequent step. If the arbitrary step experiences a disturbance in the roll axis, the roll force is transferred to the subsequent step via the first flange interface 15 and the second flange interface 16. Thereby, the disturbance is prevented from propagating. It should be specified that the arbitrary step and the subsequent step are an adjacent pair of steps from the plurality of escalator steps 2. This locks the tilt angle between the arbitrary step and the subsequent step.

Referring to FIG. 3 and FIG. 5-7, the varying length drive mechanism 1 comprises a looping step chain 11, a plurality of outward facing deflector rollers 12 that are in the same plane as a motorized sprocket 5 thereby minimizing the escalator width 291, a first deflection track 13, and a second deflection track 14. The varying length drive mechanism 1 allows the looping step chain 11 to control the vertical and horizontal orientation of each of the plurality of escalator steps 2. The looping step chain 11 is longitudinally mounted around the escalator path 6. As such, the looping step chain 11 physically connects the plurality of escalator steps 2 to each other. Thus, if one of the plurality of escalator steps 2 is physically moved, a connected one of the plurality of escalator steps 2 also moves. Additionally, looping step chain 11 is also configured to regulate the gap between each of the plurality of escalator steps 2.

The plurality of outward facing deflector rollers 12 is distributed around the looping step chain 11. More specifically, each of the plurality of outward facing deflector rollers 12 comprises at least one roller and a connecting plate. The connecting plate offsets the at least one roller from the looping step chain 11, thereby allowing the at least one roller to engage the first deflection track 13 and the second deflection track 14. However, the preferred embodiment of the plurality of outward facing deflector rollers 12 comprises two rollers connected to the connecting plate. The looping step chain 11 mounts to the bottom portion of the connecting plate. As such, each of the plurality of outward facing deflector rollers 12 are rotatably mounted to the looping step chain 11.

As can be seen in FIG. 1A-1B, the preferred embodiment of the return side 8 has a first turnaround and a second turnaround which allows the passenger side 7 and the return side 8 to be configured as a circuit. A first comb plate positioned between the first turnaround and the passenger side 7 allows passengers to board the plurality of escalator steps 2. A second comb plate positioned between the passenger side 7 and the second turnaround allows passengers to disembark from the plurality of escalator steps 2. The first deflection track 13 and the second deflection track 14 are mounted about the looping step chain 11. Further, the first deflection track 13 and the second deflection track 14 are positioned opposite to each other along the passenger side 7 of the escalator path 6. As such, the first deflection track 13 is positioned between the first turnaround and the passenger side 7. The first deflection track 13 causes the looping step chain 11 to physically contract, which causes the plurality of escalator steps 2 to move closer to each other. This prevents horizontal movement between the any two of the plurality of escalator steps 2 traveling along the passenger side 7, thereby preventing objects from being entrapped between the plurality of escalator steps 2.

Referring specifically to FIG. 1B, the second deflection track 14 is positioned between the passenger side 7 and the second turnaround. The first turnaround and second turnaround cause the plurality of escalator steps 2 to travel in a circular path. This requires each of the plurality of escalator steps 2 to rotate about its longitudinal axle, a condition which is not possible if each of the plurality of escalator steps 2 are too close to each other. As such, the second deflection track 14 is configured to increase the distance between each of the plurality of escalator steps 2 as the plurality of escalator steps 2 travels between the passenger side 7 and the second turnaround.

Referring specifically to FIG. 1A, the first deflection track 13 is engaged by a plurality of proximal rollers 121 from the plurality of outward facing deflector rollers 12. More specifically, when entering the passenger side 7, the first deflection track 13 causes the plurality of proximal rollers 121 to deflect downwards, thereby causing the chain links to rotate. This causes the section of the looping step chain 11 attached to the plurality of proximal rollers 121 to contract, which pulls an arbitrary two of the plurality of escalator steps 2 closer together.

Likewise, the second deflection track 14 is engaged by a second plurality of proximal rollers 122 from the plurality of outward facing deflector rollers 12. This causes the section of the looping step chain 11 engaged to the second plurality of proximal rollers 122 to contract, thereby reducing the linear distance between an arbitrary two of the plurality of escalator steps 2.

FIG. 2 shows a motorized sprocket 5 driving the looping step chain 11 about the escalator path 6. The motorized sprocket 5 is operatively coupled to the looping step chain 11. More specifically, the motorized sprocket 5 is used to drive movement of the looping step chain 11 with the plurality of outward facing deflector rollers 12 that are in the same plane as the motorized sprocket 5. The motorized sprocket 5 is driven via an electric or chemical power source. For example, an electric motor or an internal combustion engine may be interchangeably used. A series of grooves positioned radially about the motorized sprocket 5 each accepts a step axle 26 from the plurality of escalator steps 2. The step axle 26 is rotatably placed within each of the series of grooves, thereby creating a mechanical connection between the motorized sprocket 5 and the plurality of escalator steps 2. In the preferred implementation, the motorized sprocket 5 is positioned coaxial to the second turnaround of the return side 8. Only the proximal steps from the plurality of escalator steps 2 are actively driven by the motorized sprocket 5. The rest of the plurality of escalator steps 2 are passively pulled along by the looping step chain 11.

As can be seen in FIG. 4, in the preferred embodiment of the present invention, the plurality of outward facing deflector rollers 12, the looping step chain 11, and the operative coupling between the motorized sprocket 5 and the looping step chain 11 are positioned coplanar to each other. This allows the motorized sprocket 5 to nestle between the chain links of the looping step chain 11.

Referring now to FIG. 1A, the first deflection track 13 comprises a starting S-curved portion 131 enabling the looping step chain 11 to extend to its full length while traveling through a return side 8 of the escalator path 6 such that the plurality of escalator steps 2 are separated from each other so as to prevent two adjacent first step mounted angled flange from interfering with each other and so as to prevent two adjacent second step mounted angled flange from interfering with each other. The starting S-curved portion 131 allows a smooth transition between a raised portion of the first deflection track 13 and a lowered portion. The plurality of escalator steps 2 comprises a plurality of passenger-side steps 21 and a plurality of return-side steps 22. More specifically, the portion of the plurality of escalator steps 2 traveling along the passenger side 7 is called the plurality of passenger-side steps 21, and the portion of the plurality of escalator steps 2 traveling along the return side 8 is called the plurality of return-side steps 22. The starting S-curved portion 131 is operatively engaged to the plurality of return-side steps 22. Further, the starting S-curved portion 131 is used to re-engage the plurality of return-side steps 22 into the plurality of passenger-side steps 21. More specifically, the staring S-curved portion 131 reduces the linear distance between the any two of the plurality of return-side steps 22, thereby forming the plurality of passenger-side steps 21.

As can be seen in FIG. 2, the second deflection track 14 comprises an ending S-curved portion 141 enabling the looping step chain 11 to extend to its full length while traveling through a return side 8 of the escalator path 6 such that the plurality of escalator steps 2 are separated from each other so as to prevent two adjacent first step mounted angled flanges from interfering with each other and so as to prevent two adjacent second step mounted angled flanges from interfering with each other. The ending S-curved portion 141 connects the lowered portion of the second deflection track 14 to a raised portion. The ending S-curved portion 141 is terminally positioned with the escalator path 6. More specifically, the S-curve portion is positioned between the passenger side 7 and the second turnaround of the return side 8. Accordingly, the ending S-curved portion 141 is operatively engaged to the plurality of passenger-side steps 21. Further, the ending S-curved portion 141 is used to disengage the plurality of passenger-side steps 21 into the plurality of return-side steps 22. As such, the ending S-curved portion 141 increases the gap between any two of the plurality of passenger-side steps 21, thereby forming the plurality of return-side steps 22.

As can be seen in FIG. 2-3, each of the plurality of escalator steps 2 comprises a step axle 26. The step axle 26 allows the transfer of translational force between the looping step chain 11 and the plurality of escalator steps 2. Accordingly, the step axle 26 is terminally connected to the elongated step body 23. At least two rollers are terminally and rotatably connected to the step axle 26. The at least two rollers allow the plurality of escalator steps 2 to translate freely along the escalator path 6. The step axle 26 is positioned perpendicular to the escalator path 6. In particular, the plurality of escalator steps 2 is physically constrained to preserve the perpendicular alignment between the step axle 26 and the escalator path 6. This is a necessary condition which prevents the plurality of escalator steps 2 from sliding around. The step axle 26 is pivotably connected to the looping step chain 11. In particular, at least two chain links of the looping step chain 11 are coaxially connected to the step axle 26. As such, the chain links can rotate freely about the step axle 26, thereby adjusting the linear distance between any two of the plurality of escalator steps 2.

Referring once more to FIG. 3, in the preferred embodiment of the present invention, the step axle 26 is positioned offset from the riser surface 231. In this embodiment, a substantial part of the elongated step body 23 lies below the looping step chain 11 when the plurality of escalator steps 2 travel through the return side 8. In contrast, when the plurality of escalator steps 2 is traveling through the passenger side 7, the elongated step body 23 lies completely on top of the looping step chain 11.

Figure 8:
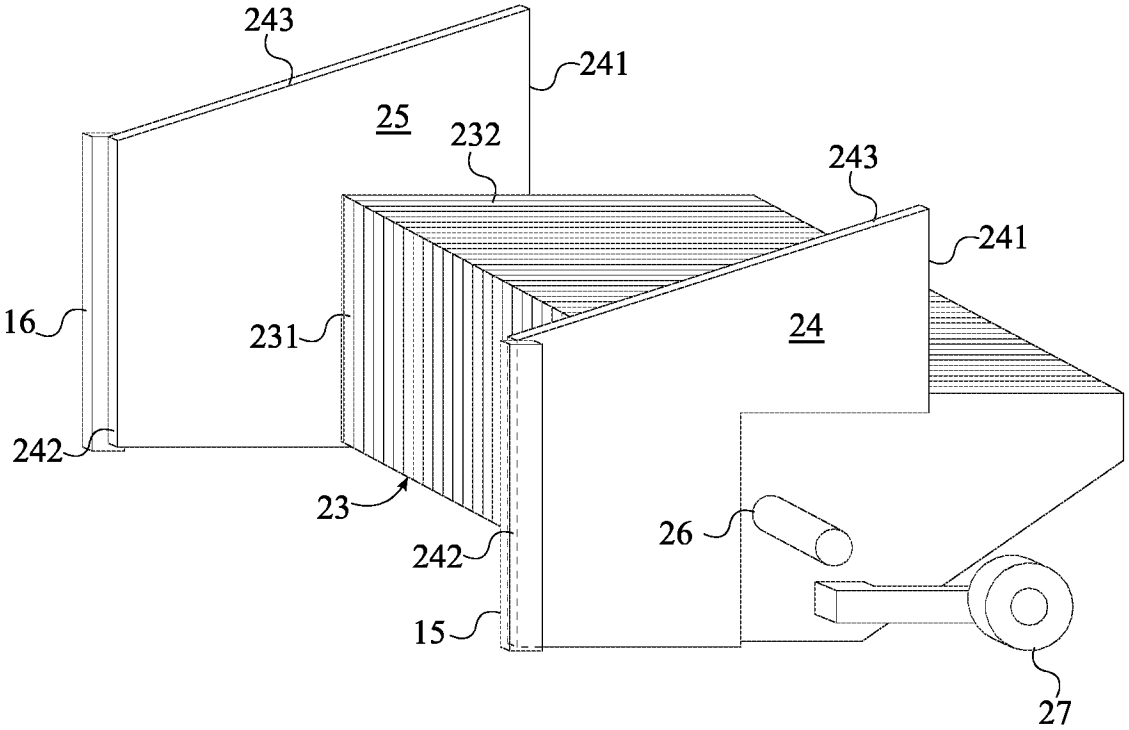
FIG. 8 is a perspective view of the low-profile embodiment of one of the plurality of escalator steps.

Referring to FIG. 8, in a low-profile embodiment of the present invention, the step axle 26 is positioned adjacent to the riser surface 231. More specifically, the step axle 26 is positioned closer to the center of the elongated step body 23. As a result, the looping step chain 11 is raised in relation to the elongated step body 23, as the plurality of escalator steps 2 travels along the passenger side 7. In addition, this reduces the effective height of the first step mounted angled flange 24 and the second step mounted angled flange 25, thereby enabling the use of a low profile first decking 3 and second decking 4.

As is illustrated in FIG. 1A-2, the varying length drive mechanism 1 further comprises at least one looping step track 17. The looping step track 17 supports the weight of a portion of the elongated step body 23 and helps position the plurality of escalator steps 2 in the desired position. Accordingly, the looping step track 17 is longitudinally mounted around the escalator path 6. Each of the plurality of escalator steps 2 comprises a step roller 27. The step roller 27 reduces the friction between the at least one looping step track 17 and the elongated step body 23, thereby allowing the plurality of escalator steps 2 to translate freely along the at least one looping step track 17. As such, the step roller 27 is terminally and rotatably mounted to the step body. Additionally, the step roller 27 is tangentially engaged to the looping step track 17.

Figure 6:
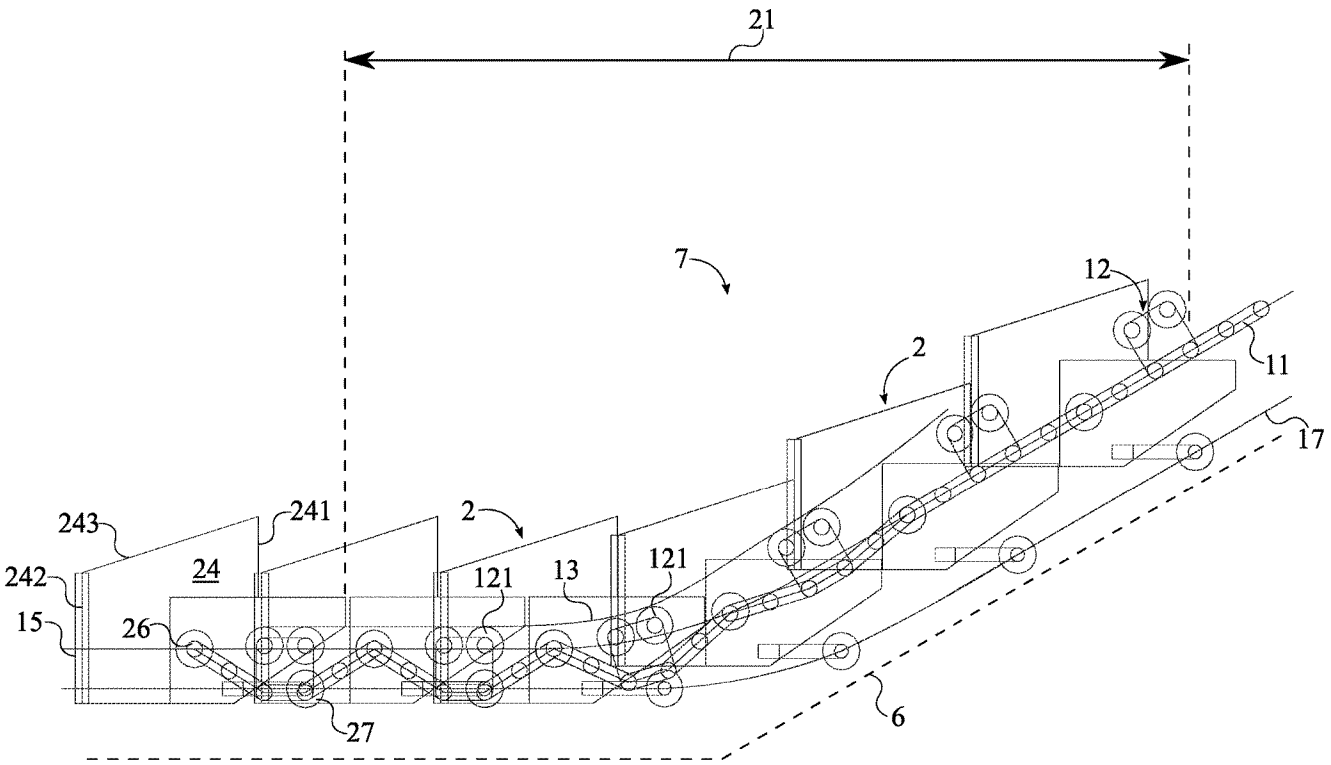
FIG. 6 is a side planform view of the low-profile embodiment of the plurality of escalator steps traveling along the passenger side.
Figure 7:
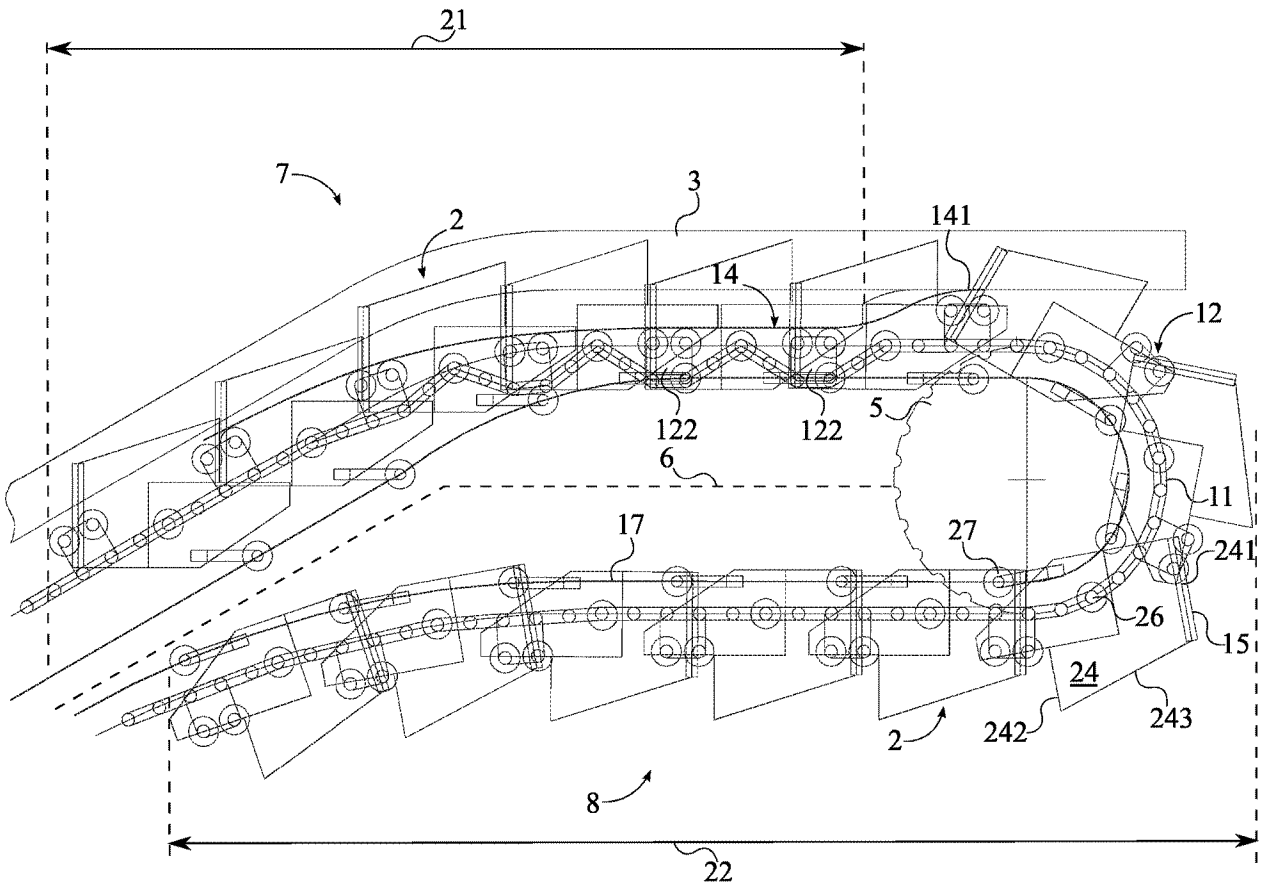
FIG. 7 is a side planform view of the low-profile embodiment of the plurality of escalator steps traveling from the passenger side to the return side of the escalator path.

In the preferred embodiment of the present invention, the step roller 27 is positioned adjacent to the riser surface 231. As can be seen in FIG. 6-7, in the low-profile embodiment of the elongated step body 23, the step roller 27 is positioned offset from the riser surface 231. This reduces the effective height of the elongated step body 23.

As can be seen in FIG. 1A-1B, the preferred embodiment of the first continuous barrier 28 is configured to be overlapped by the first decking 3. As such, the distal edge 243 of the first step mounted angled flange 24 is oriented parallel or nearly parallel to the inclination zone of the escalator path 6, so that the first formed angle 244 is parallel or nearly parallel to the first decking interface 18 thereby minimizing the decking heights. Further, the distal edge 243 of the first step mounted angled flange 24 and a lower edge of the first decking 3 is positioned offset from each other, thereby causing the first step mounted angled flange 24 to be overlapped by the first decking 3. The offset also causes the first decking 3 to remain extended over the first step mounted angled flange 24, as the plurality of escalator steps 2 travels along the passenger side 7. This eliminates gaps from forming on the upper portion of the first continuous barrier 28.

As is apparent from FIG. 2, the second continuous barrier 29 is configured to be overlapped by the second decking 4. As such, the distal edge 243 of the second step mounted angled flange 25 is oriented parallel or nearly parallel to an inclination zone of the escalator path 6, so that the second formed angle 254 is parallel or nearly parallel to the second decking interface 19 thereby minimizing the decking heights. Further, the distal edge 243 of the second step mounted angled flange 25 and a lower edge of the second decking 4 is positioned offset from each other, thereby causing the second step mounted angled flange 25 to be overlapped by the second decking 4. This allows the second decking 4 to remain extended over the second step mounted angled flange 25 and prevents gaps from forming on the upper portion of the second continuous barrier 29.

Figure 9:
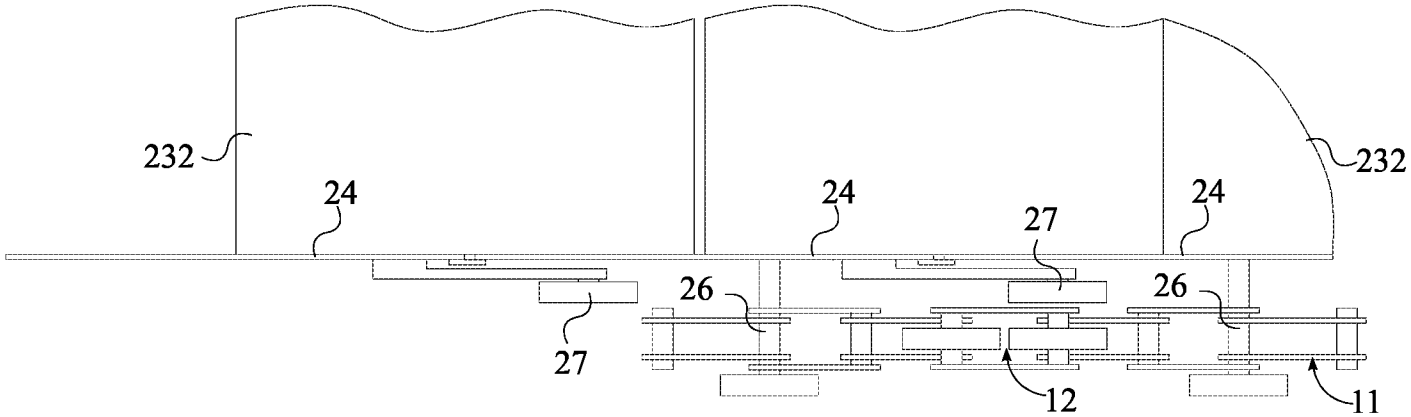
FIG. 9 is a top planform view of the low-profile embodiment of the plurality of escalator steps, their step axles, and step chain.
Figure 10:
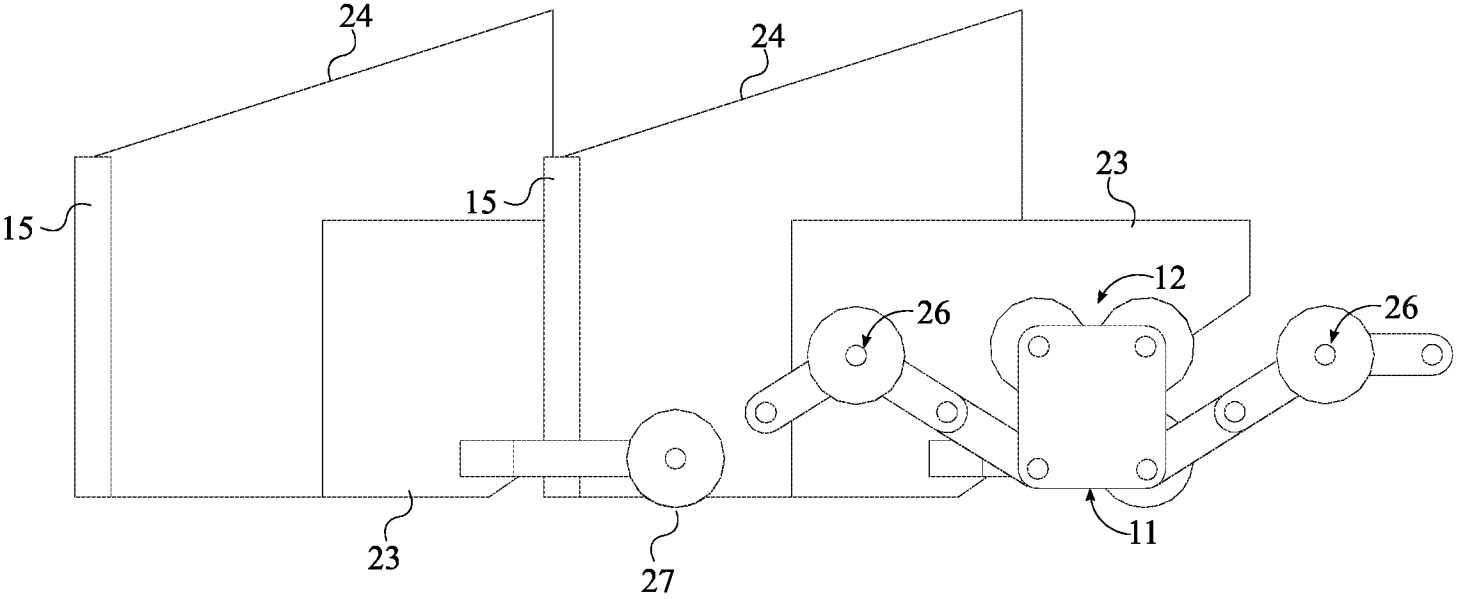
FIG. 10 is a side planform view of the low-profile embodiment of the plurality of escalator steps, their step axles, and step chain.

As is apparent from FIG. 8-10, in the low-profile embodiment of the elongated step body 23, each of the plurality of escalator steps 2 comprises a first flange interface 15. The first flange interface 15 overlaps the adjacent first step mounted angled flange 24 of the low-profile elongated step body 23. As such, the first flange interface 15 is connected along the trailing edge 242 of the first step mounted angled flange 24. Further, the trailing edge 242 of the first step mounted angled flange 24 is positioned offset from the riser surface 231. As such, the first step mounted angled flange 24 of an arbitrary step overlaps a portion of an adjacent step. Additionally, this positions the first flange interface 15 of the arbitrary step coincident and adjacent to the first step mounted angled flange 24 of an adjacent step. Likewise, a leading edge 241 of the first step mounted angled flange 24 is positioned adjacent to the distal edge 243 of the first step mounted angled flange 24, opposite the trailing edge 242 of the first step mounted angled flange 24. This allows the leading edge 241 of an arbitrary step to contact the trailing edge 242 of the adjacent step. As a result, the first flange interface 15 of an arbitrary step overlaps the leading edge 241 of the first step mounted angled flange 24 of a preceding step, wherein the arbitrary step and the preceding step are an adjacent pair of steps from the plurality of escalator steps 2. More specifically, the first flange interface 15 of the arbitrary step overlaps the outer lateral surface of the trailing edge 242 of a preceding step.

Referring specifically to FIG. 8, each of the plurality of escalator steps 2 comprises a second flange interface 16. A trailing edge 242 of the second step mounted angled flange 25 is positioned adjacent to a distal edge 243 of the second step mounted angled flange 25. The second flange interface 16 is connected along the trailing edge 242 of the second step mounted angled flange 25. Further, the trailing edge 242 of the second step mounted angled flange 25 is positioned offset from the riser surface 231. As such, the second step mounted angled flange 25 of an arbitrary step overlaps a portion of an adjacent step. Additionally, this positions the second flange interface 16 of the arbitrary step coincident and adjacent to the first flange 25 of an adjacent step. Likewise, a leading edge 241 of the second step mounted angled flange 25 is positioned adjacent to the distal edge 243 of the second step mounted angled flange 25, opposite the trailing edge 242 of the second step mounted angled flange 25. This allows the leading edge 241 of an arbitrary step to contact the trailing edge 242 of an adjacent step. The second flange interface 16 of an arbitrary step overlaps the leading edge 241 of the second step mounted angled flange 25 of a preceding step, wherein the arbitrary step and the preceding step are an adjacent pair of steps from the plurality of escalator steps 2. More specifically, the second flange interface 16 of the arbitrary step overlaps the outer lateral surface of the second step mounted angled flange 25 of a preceding step. Thus, the first flange interface 15 and the second flange interface 16 of an arbitrary step provide light barriers between the first step mounted angled flange 24 of adjacent steps and the second step mounted angled flange 25 of adjacent steps.

Although the invention has been explained in relation to its preferred embodiment, it is to be understood that many other possible modifications and variations can be made without departing from the spirit and scope of the invention as hereinafter claimed.

What is claimed is:

1. An escalator system with vertical step risers and step mounted angled side flanges comprising:

a plurality of escalator steps;

at least one varying length drive mechanism;

a first decking;

a second decking;

each of the plurality of escalator steps comprising an elongated step body, a first step mounted angled flange, a first flange interface, a second step mounted angled flange and a second flange interface;

the elongated step body comprising a riser surface and a stepping surface;

the at least one varying length drive mechanism being configured to move the plurality of escalator steps in a loop around an escalator path while changing a distance between step attachment points while traveling through a passenger side of the escalator path in a manner that does not impart any horizontal acceleration while the plurality of escalator steps move vertically through transition zones while maintaining intermeshing of the plurality of escalator steps;

the riser surface and the stepping surface being positioned perpendicular or nearly perpendicular with each other;

the first step mounted angled flange being terminally connected to the elongated step body;

the second step mounted angled flange being terminally connected to the elongated step body;

the first step mounted angled flange being located opposite to the second step mounted angled flange, along the elongated step body;

the first step mounted angled flange and the second step mounted angled flange each extending away from the stepping surface so that a first formed angle is parallel or nearly parallel to a first decking interface and a second formed angle is parallel or nearly parallel to a second decking interface thereby minimizing decking heights;

the first step mounted angled flange for each of the plurality of escalator steps being configured to form a first continuous barrier between the first decking and the elongated step body for each of the plurality of escalator steps;

the second step mounted angled flange for each of the plurality of escalator steps being configured to form a second continuous barrier between the second decking and the elongated step body for each of the plurality of escalator steps;

the first continuous barrier and the second continuous barrier being positioned adjacent to the passenger side of the escalator path;

the first step mounted angled flange and the second step mounted angled flange each comprising a leading edge, a distal edge and a trailing edge, the leading edge and the trailing edge each being positioned adjacent to the distal edge, the leading edge and the trailing edge being located opposite to each other, the leading edge being positioned opposite to the riser surface across the stepping surface;

the first flange interface being connected along the leading edge of the first step mounted angled flange;

the second flange interface being connected along the leading edge of the second step mounted angled flange;

the first flange interface of an arbitrary step overlapping the trailing edge of the first step mounted angled flange of a subsequent step;

the second flange interface of the arbitrary step overlapping the trailing edge of the second step mounted angled flange of the subsequent step; and the arbitrary step and the subsequent step being an adjacent pair of steps from the plurality of escalator steps.

2. The escalator system with vertical step risers and step mounted angled side flanges as claimed in claim 1 comprising:

the at least one varying length drive mechanism comprising a looping step chain, a plurality of outward facing deflector rollers that are in the same plane as a motorized sprocket thereby minimizing an escalator width, a first deflection track and a second deflection track;

the looping step chain being longitudinally mounted around the escalator path;

each of the plurality of escalator steps being pivotably coupled to the looping step chain;

the first deflection track and the second deflection track being mounted about the looping step chain;

the first deflection track and the second deflection track being positioned opposite to each other along the passenger side of the escalator path;

the plurality of outward facing deflector rollers being distributed around the looping step chain; and each of the plurality of outward facing deflector rollers being rotatably mounted to the looping step chain.

3. The escalator system with vertical step risers and step mounted angled side flanges as claimed in claim 2 comprising:

the first deflection track being engaged by a plurality of proximal rollers from the plurality of outward facing deflector rollers.

4. The escalator system with vertical step risers and step mounted angled side flanges as claimed in claim 2 comprising:

the second deflection track being engaged by a plurality of proximal rollers from the plurality of outward facing deflector rollers.

5. The escalator system with vertical step risers and step mounted angled side flanges as claimed in claim 2 comprising:

the motorized sprocket being operatively coupled to the looping step chain; and the motorized sprocket being used to drive movement of the looping step chain with the plurality of outward facing deflector rollers that are in the same plane as the motorized sprocket.

6. The escalator system with vertical step risers and step mounted angled side flanges as claimed in claim 5 comprising:

the plurality of outward facing deflector rollers, the looping step chain, and an operative coupling between the plurality of outward facing deflector rollers, the motorized sprocket and the looping step chain being positioned coplanar to each other.

7. The escalator system with vertical step risers and step mounted angled side flanges as claimed in claim 2 comprising:

the first deflection track comprising a starting S-curved portion enabling the looping step chain to extend to its full length while traveling through a return side of the escalator path such that the plurality of escalator steps are separated from each other so as to prevent two adjacent first step mounted angled flanges from interfering with each other and so as to prevent two adjacent second step mounted angled flanges from interfering with each other;

the plurality of escalator steps comprising a plurality of passenger-side steps and a plurality of return-side steps;

the starting S-curved portion being terminally positioned with the escalator path;

the starting S-curved portion being operatively engaged to the plurality of return-side steps; and the starting S-curved portion being used to re-engage the plurality of return-side steps into the plurality of passenger-side steps.

8. The escalator system with vertical step risers and step mounted angled side flanges as claimed in claim 2 comprising:

the second deflection track comprise an ending S-curved portion enabling the looping step chain to extend to its full length while traveling through a return side of the escalator path such that the plurality of escalator steps are separated from each other so as to prevent two adjacent first step mounted angled flanges from interfering with each other and so as to prevent two adjacent second step mounted angled flanges from interfering with each other;

the plurality of escalator steps comprising a plurality of passenger-side steps and a plurality of return-side steps;

the ending S-curved portion being terminally positioned with the escalator path;

the ending S-curved portion being operatively engaged to the plurality of passenger-side steps; and the ending S-curved portion being used to dis-engage the plurality of passenger-side steps into the plurality of return-side steps.

9. The escalator system with vertical step risers and step mounted angled side flanges as claimed in claim 1 comprising:

each of the plurality of escalator steps comprising a step axle;

the step axle being terminally connected to the elongated step body;

the step axle being positioned perpendicular to the escalator path; and the step axle being pivotably connected to the looping step chain.

10. The escalator system with vertical step risers and step mounted angled side flanges as claimed in claim 9 comprising:

the step axle being positioned offset from the riser surface.

11. The escalator system with vertical step risers and step mounted angled side flanges as claimed in claim 9 comprising:

the step axle being positioned adjacent to the riser surface.

12. The escalator system with vertical step risers and step mounted angled side flanges as claimed in claim 1 comprising:

the at least one varying length drive mechanism comprising at least one looping step track;

each of the plurality of escalator steps comprising a step roller;

the looping step track being longitudinally mounted around the escalator path;

the step roller being terminally and rotatably mounted to the elongated step body; and the step roller being tangentially engaged to the looping step track.

13. The escalator system with vertical step risers and step mounted angled side flanges as claimed in claim 12 comprising:

the step roller being positioned adjacent to the riser surface.

14. The escalator system with vertical step risers and step mounted angled side flanges as claimed in claim 12 comprising:

the step roller being positioned offset from the riser surface.

15. The escalator system with vertical step risers and step mounted angled side flanges as claimed in claim 1 comprising:

the distal edge of the first step mounted angled flange being oriented parallel or nearly parallel to an inclination zone of the escalator path so that the first formed angle is parallel or nearly parallel to the first decking interface thereby minimizing the decking heights;

the first step mounted angled flange being overlapped by the first decking; and the distal edge of the first step mounted angled flange and a lower edge of the first decking being positioned offset from each other.

16. The escalator system with vertical step risers and step mounted angled side flanges as claimed in claim 1 comprising:

the distal edge of the second step mounted angled flange being oriented parallel or nearly parallel to an inclination zone of the escalator path so that the second formed angle is parallel or nearly parallel to the second decking interface thereby minimizing the decking heights;

the second step mounted angled flange being overlapped by the second decking; and the distal edge of the second step mounted angled flange and a lower edge of the second decking being positioned offset from each other.

* * * * *